US009521502B2

(12) United States Patent
Faller et al.

(10) Patent No.: US 9,521,502 B2
(45) Date of Patent: Dec. 13, 2016

(54) METHOD FOR DETERMINING A STEREO SIGNAL

(71) Applicants: Christof Faller, Munich (DE); David Virette, Munich (DE); Yue Lang, Beijing (CN)

(72) Inventors: Christof Faller, Munich (DE); David Virette, Munich (DE); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 17 days.

(21) Appl. No.: 14/764,754

(22) PCT Filed: Jan. 4, 2013

(86) PCT No.: PCT/EP2013/050112
§ 371 (c)(1),
(2) Date: Jul. 30, 2015

(87) PCT Pub. No.: WO2014/106543
PCT Pub. Date: Jul. 10, 2014

(65) Prior Publication Data

US 2016/0234621 A1 Aug. 11, 2016

(51) Int. Cl.

| | |
|---|---|
| ***H04S 7/00*** | (2006.01) |
| ***H04R 5/027*** | (2006.01) |
| ***H04R 5/04*** | (2006.01) |
| ***H04S 1/00*** | (2006.01) |
| ***H04R 1/40*** | (2006.01) |
| ***H04R 3/00*** | (2006.01) |

(52) U.S. Cl.
CPC ..... *H04S 7/301* (2013.01); *H04R 1/406* (2013.01); *H04R 3/005* (2013.01); *H04R 5/027* (2013.01); *H04R 5/04* (2013.01); *H04S 1/002* (2013.01); *H04S 2400/09* (2013.01); *H04S 2400/15* (2013.01)

(58) Field of Classification Search
None
See application file for complete search history.

(56) References Cited

FOREIGN PATENT DOCUMENTS

WO 2010028784 A1 3/2010

OTHER PUBLICATIONS

Bernfeld, B., "Attempts for Better Understanding of the Directional Stereophonic Listening Mechanism," Feb. 20-22, 1973, 27 pages.

(Continued)

*Primary Examiner* — Curtis Kuntz
*Assistant Examiner* — Kenny Truong
(74) *Attorney, Agent, or Firm* — Conley Rose, P.C.

(57) ABSTRACT

A method for determining an output stereo signal comprising determining a first differential signal and determining a second differential signal; determining a first power spectrum based on the first differential signal and determining a second power spectrum based on the second differential signal; determining a first weighting function and a second weighting function as a function of the first power spectrum and the second power spectrum; and filtering a first signal, which represents a first combination of the first input audio channel signal and the second input audio channel signal, and filtering a second signal, which represents a second combination of the first input audio channel signal and the second input audio channel signal.

15 Claims, 5 Drawing Sheets

(56) References Cited

OTHER PUBLICATIONS

Baumgarte, F., et al., "Binaural Cue Coding—Part I: Psychoacoustic Fundamentals and Design Principles," IEEE Transactions on Speech and Audio Processing, vol. 11, No. 6, Nov. 2003, pp. 509-519.
Faller, C., et al., "Binaural Cue Coding—Part II: Schemes and Applications," IEEE Transactions on Speech and Audio Processing, vol. 11, No. 6, Nov. 2003, pp. 520-531.
Schuijers, E., et al., "Low Complexity parametric stereo coding," Audio Engineering Society, Convention Paper 6073, May 8-11, 2004, 11 pages.
Faller, C., et al., "Parametric Coding of Spatial Audio," 2004, 180 pages.
Olson, H., et al., "Gradient Microphones," The Journal of the Acoustical Society of America, vol. 17, No. 3, Jan. 1946, 7 pages.
Faller, C., et al., "Conversion of Two Closely Spaced Omnidirectional Microphone Signals to an XY Stereo Signal," Audio Engineer Society, Convention Paper 8188, Nov. 4-7, 2010, 10 pages.
Thiergart, O., et al., "Diffuseness Estimation with High Temporal Resolution Via Spatial Coherence Between Virtual First-Order Microphones," IEEE Workshop on Applications of Signal Processing to Audio and Acoustics, Oct. 16-19, 2011, 4 pages.
Foreign Communication From a Counterpart Application, PCT Application No. PCT/EP2013/050112, International Search Report dated Sep. 27, 2013, 5 pages.
Foreign Communication From a Counterpart Application, PCT Application No. PCT/EP2013/050112, Written Opinion dated Sep. 27, 2013, 6 pages.

METHOD FOR DETERMINING A STEREO SIGNAL

CROSS-REFERENCE TO RELATED APPLICATION

This application is a filing under 35 U.S.C. §371 as the National Stage of International Application No. PCT/EP2013/050112, filed on Jan. 4, 2013, which is hereby incorporated by reference in its entirety.

BACKGROUND

The present invention relates to a method, a computer program and an apparatus for determining a stereo signal.

A stereo microphone usually uses two directional microphone elements to directly record a signal suitable for stereo playback. A directional microphone is a microphone that picks up sound from a certain direction, or a number of directions, depending on the model involved, e.g., cardioid or figure eight microphones. Directional microphones are expensive and difficult to build into small devices. Thus, usually omni-directional microphone elements are used in mobile devices. An omni-directional or non-directional microphone's response is generally considered to be a perfect sphere in three dimensions. However, a stereo signal yielded by omni-directional microphones has only little left-right signal separation. Indeed, due to the small distance of only few centimeters between the two omni-directional microphones, the stereo image width is rather limited as the energy and delay differences between the channels are small. The energy and delay differences are known as spatial cues and they directly affect the spatial perception as explained in J. Blauert, "Spatial Hearing: The Psychoacoustics of Human Sound Localization", MIT Press, Cambridge, USA, 1997. Thus, techniques have been proposed to convert omni-directional microphone signals to stereo signals with more separation as shown by C. Faller, "Conversion of two closely spaced omnidirectional microphone signals to an xy stereo signal," in Preprint 129th Convention AES, 2010.

The weakness of the previously described method is that the differential signals have low signal-to-noise ratio at low frequencies and spectral defects at higher frequencies. The technique proposed in C. Faller, "Conversion of two closely spaced omnidirectional microphone signals to an xy stereo signal," in Preprint 129th Convention AES, 2010, attempts to avoid these issues by using the differential signals ($x_1$ and $x_2$) only for computing a gain filter, which is then applied to the original microphone signals ($m_1$ and $m_2$), and which achieves a good signal to noise ratio (SNR) and reduced spectral defects.

This technique, however, is limited to a specific stereo image or a specific sound recording scenario.

SUMMARY

It is the object of the invention to provide an improved technique for capturing or processing a stereo signal.

This object is achieved by the features of the independent claims. Further implementation forms are apparent from the dependent claims, the description and the figures.

The invention is based on the finding that the above conventional technique does not offer the possibility to adapt the stereo width of a captured or processed stereo signal. The gain filter is computed for providing a fixed stereo image which cannot be modified to control the stereo image or cannot be changed online by the user. Thus, the stereo microphone does not give an optimal stereo signal without placing it at an optimal position. For example, the distance of the microphone to the objects to be recorded has to be manually chosen such that the sector enclosing the objects has an angle which corresponds to the sector which the stereo microphone captures.

The invention is further based on the finding that applying a width control provides an improved technique for capturing or processing stereo signals. By using an additional control parameter, which directly controls the stereo width of an input stereo signal, the stereo signal can be made narrower or wider with the positions of the objects to be recorded spanning the corresponding stereo image width. This control parameter can also be referred to as stereo width control parameter, For controlling the stereo width, the differential signal statistics can be easily adjusted or modified as required by introducing and modifying an exponential parameter to the weighting function.

In order to describe the invention in detail, the following terms, abbreviations and notations will be used.

M1, M2: first (left) and second (right) microphones.

$m_1$, $m_2$: first and second input audio channel signals, e.g. first and second microphone signals.

$x_1$, $x_2$: first and second differential signals of $m_1$ and $m_2$.

$P_1(k,i)$, $P_2(k,i)$: power spectra of the first (left) and second (right) differential signals, $X_1(k,i)$, $X_2(k,i)$: spectra of the first (left) and second (right) differential signals, $Y_1(k,i)$, $Y_2(k,i)$: spectra of the first (left) and second (right) stereo output signals, $Y_1$, $Y_2$: first (left) and second (right) output audio channel signals $W_1(k,i)$, $W_2(k,i)$: first (left) and second (right) weighting functions, e.g. first (left) and second (right) stereo gain filters, $\beta$: stereo width control parameter, $D(k,i)$: diffuse sound reverberation, $\Phi(k,i)$: normalized cross correlation between the first (left) and second (right) differential signals, L: left output signal or left output audio channel signal, R: right output signal or right output audio channel signal, STFT: Short Time Fourier Transform, SNR: Signal-to-Noise Ratio, BCC: Binaural Cue Coding, CLD: Channel Level Differences ILD: Interchannel Level Differences, ITD: Interchannel Time Differences, ICC: Interchannel Coherence/Cross Correlation, QMF: Quadrature Mirror Filter.

According to a first aspect, the invention relates to a method for determining an output stereo signal based on an input stereo signal, the input stereo signal comprising a first input audio channel signal and a second input audio channel signal, the method comprising determining a first differential signal based on a difference of the first input audio channel signal and a filtered version of the second input audio channel signal and determining a second differential signal based on a difference of the second input audio channel signal and a filtered version of the first input audio channel signal; determining a first power spectrum based on the first differential signal and determining a second power spectrum based on the second differential signal; determining a first and a second weighting function as a function of the first and the second power spectra; wherein the first and the second weighting functions comprise an exponential function; and filtering a first signal, which represents a first combination of the first input audio channel signal and the second input audio channel signal, with the first weighting function to obtain a first output audio signal of the output stereo signal, and filtering a second signal, which represents a second combination of the first input audio channel signal and the second input audio channel signal with the second weighting function to obtain a second output audio channel signal of the output stereo signal.

By using the exponential function as an additional parameter for the first and second weighting functions, the stereo width of the stereo signal can be controlled depending on an exponent of the exponential function. Thus, the stereo signal can be optimally captured or processed just by controlling the stereo width and without the need of placing the microphone at an optimum position or adjusting the microphones' relative positions and/or orientation.

In a first possible implementation form of the method according to the first aspect, the first signal is the first input audio channel signal and the second signal is the second input audio channel signal.

When filtering the first and second input audio channel signals, the filtering is easy to implement.

In a second possible implementation form of the method according to the first aspect as such or according to the first implementation form of the first aspect, the first signal is the first differential signal and the second signal is the second differential signal.

When filtering the first and second differential signals, the method provides a stereo signal with improved left-right separation.

In a third possible implementation form of the method according to the second implementation form of the first aspect, an exponent of the exponential function lies between 0.5 and 2.

For an exponent of 1, the stereo width of the first and second differential signals is used, for an exponent greater than 1, the image is made wider, for an exponent smaller than 1, the image is made narrower. The image width thus can be flexibly controlled. The exponent can therefore also be referred to as "stereo width control parameter". In alternative implementation forms other ranges for the exponent are chosen, e.g. between 0.25 and 4, between 0.2 and 5, between 0.1 and 10 etc. However, the range from 0.5 to 2 has shown to be in particular well fitting to the human perception of stereo width.

In a fourth possible implementation form of the method according to the first aspect as such or according to any of the preceding implementation forms of the first aspect, the determining the first and the second weighting function comprises normalizing an exponential version of the first power spectrum by a normalizing function; and normalizing an exponential version of the second power spectrum by the normalizing function, wherein the normalizing function is based on a sum of the exponential version of the first power spectrum and the exponential version of the second power spectrum.

By normalizing the power spectra by the same normalizing function, the power ratio between left and right channel is preserved in the stereo signal. When using a short time average for computing the power spectra, the acoustical impression is improved.

In a fifth possible implementation form of the method according to the first aspect as such or according to any of the preceding implementation forms of the first aspect, the first and the second weighting functions depend on a power spectrum of a diffuse sound of the first and second microphone signals, in particular a reverberation sound of the first and second microphone signals.

The method thus allows considering an undesired signal such as diffuse sound. The weighting functions can attenuate the undesired signal thereby improving perception and quality of the stereo signal.

In a sixth possible implementation form of the method according to the first aspect as such or according to any of the preceding implementation forms of the first aspect, the first and the second weighting functions depend on a normalized cross correlation between the first and the second differential signals.

The normalized cross correlation function between the differential signals is easy to compute when using digital signal processing techniques.

In a seventh possible implementation form of the method according to the first aspect as such or according to any of the preceding implementation forms of the first aspect, the first and the second weighting functions depend on a minimum of the first and the second power spectra.

The minimum of the power spectra can be used as a measure indicating reverberation of the microphone signals.

In an eighth possible implementation form of the method according to the first aspect as such or according to any of the preceding implementation forms of the first aspect, the determining the first ($W_1$) and the second ($W_2$) weighting function comprises:

$$W_1(k, i) = \sqrt{\frac{P_1^\beta(k, i)}{P_1^\beta(k, i) + P_2^\beta(k, i)}}$$

and $$W_2(k, i) = \sqrt{\frac{P_2^\beta(k, i)}{P_1^\beta(k, i) + P_2^\beta(k, i)}},$$

or comprises:

$$W_1(k, i) = \sqrt{\frac{P_1^\beta(k, i) + (g-1)D^\beta(k, i)}{P_1^\beta(k, i) + P_2^\beta(k, i)}}$$

and $$W_2(k, i) = \sqrt{\frac{P_2^\beta(k, i) + (g-1)D^\beta(k, i)}{P_1^\beta(k, i) + P_2^\beta(k, i)}},$$

where $P_1(k,i)$ denotes the first power spectrum, $P_2(k,i)$ denotes the second power spectrum, $W_1(k,i)$ denotes the weighting function with respect to the first power spectrum, $W_2(k,i)$ denotes the weighting function with respect to the second power spectrum, $D(k,i)$ is a power spectrum of a diffuse sound determined as $D(k,i)=\Phi(k,i)\min(P_1(k,i), P_2(k,i))$, where $\Phi(k,i)$ is a normalized cross-correlation between the first and the second differential signals, g is a gain factor, $\beta$ is an exponent of the exponential function, k is a time index and i is a frequency index.

The method provides gain filtering of microphone signals with widening and noise control. The obtained stereo signal is characterized by improved left-right separation and noise reduction properties.

In a ninth possible implementation form of the method according to the first aspect as such or according to any of the preceding implementation forms of the first aspect, the method further comprises determining a spatial cue, in particular one of a channel level difference, an inter-channel time difference, an inter-channel phase difference and an inter-channel coherence/cross correlation based on the first output audio channel signal and the second output audio channel signal of the output stereo signal.

The method can be applied for parametric stereo signals in coders/decoders using spatial cue coding. The speech quality of the decoded stereo signals is improved when their differential signal statistics is modified by an exponential function.

In a tenth possible implementation form of the method according to the first aspect as such or according to any of the preceding implementation forms of the first aspect, the first input audio channel signal and the second input audio channel signal originate from omni-directional microphones or were obtained by using omni-directional microphones.

Omni-directional microphones are not expensive and they are easy to build into small devices like mobile devices, smartphones and tablets. Applying any of the preceding methods to any input stereo signal and its corresponding input audio channel signals originating from omni-directional microphones allows in particular to improve the perceived stereo width. The input stereo signal may be, for example, an original stereo signal directly captured by omni-directional microphones and before applying further audio encoding steps, or a reconstructed stereo signal, e.g. reconstructed by decoding an encoded stereo signal, wherein the encoded stereo signal was obtained using stereo signals captured from omni-directional microphones.

In an eleventh possible implementation form of the method according to the first aspect as such or according to any of the preceding implementation forms of the first aspect, the filtered version of the first input audio channel signal is a delayed version of the first input audio channel signal and the filtered version of the second input audio channel signal is a delayed version of the second input audio channel signal.

The filtering of the microphone signals allows flexible left-right separation by adjusting the delaying.

In a twelfth possible implementation form of the method according to the first aspect as such or according to any of the preceding implementation forms of the first aspect, the first input audio channel signal is a first microphone signal of a first microphone, and the second input audio channel signal is a second microphone signal of a second microphone. The first microphone and the second microphone can be, for example, omni-directional microphones.

Applying any of the preceding methods for determining an output stereo signal on microphone signals, e.g. before applying lossy audio encoding, e.g. source encoding or spatial encoding, allows to improve the quality of any consecutive stereo coding and the perceived stereo quality of the decoded stereo signal because any encoding except for lossless encoding comes typically with the loss of spatial information contained in the original stereo signal captured by the microphones.

Applying any of the preceding methods for determining an output stereo signal on microphone signals captured by omni-directional microphones and before applying lossy audio encoding, e.g. source encoding or spatial encoding, allows in particular to improve the quality of the coding and the perceived stereo width of the decoded stereo signal, in particular for omni-directional microphones arranged close to each other, like, for example for built-in omni-directional microphones of mobile terminals.

In a thirteenth possible implementation form of the method according to the first aspect as such or according to any of the preceding implementation forms of the first aspect, a value of the exponent of the exponential function is fixed or adjustable.

A fixed value of the exponent of the exponential function allows to narrow or broaden the perceived stereo width of the output stereo signal in a fixed manner. An adjustable value of the exponent of the exponential function allows to adapt the perceived stereo width of the output stereo signal flexibly, e.g. automatically or manually based on user input via a user interface.

In a fourteenth possible implementation form of the method according to the first aspect as such or according to any of the preceding implementation forms of the first aspect, the method further comprises setting or amending a value of an exponent of the exponential function via a user interface.

According to a second aspect, the invention relates to a computer program or computer program product with a program code for performing the method according to the first aspect as such or any of the implementation forms of the first aspect when run on a computer.

According to a third aspect, the invention relates to an apparatus for determining an output stereo signal based on an input stereo signal, the input stereo signal comprising a first input audio channel signal and a second input audio channel signal, the apparatus comprising a processor for generating the output stereo signal from the first input audio channel signal and the second input audio channel signal by applying the method according to the first aspect as such or any of the implementation forms according to the first aspect.

The apparatus can be any device adapted to perform the method according to the first aspect as such or any of the implementation forms according to the first aspect. The apparatus can be, for example, a mobile device adapted to capture the input stereo signal by external or built-in microphones and to determine the output stereo signal by performing the method according to the first aspect as such or any of the implementations forms according to the first aspect. The apparatus can also be, for example, a network device or any other device connected to a device capturing or providing a stereo signal in encoded or non-encoded manner, and adapted to postprocess the stereo signal received from this capturing device as input stereo signal to determine the output stereo signal by performing the method according to the first aspect as such or any of the implementations forms according to the first aspect.

In a first possible implementation form of the apparatus according to the third aspect, the apparatus comprises a memory for storing a width control parameter controlling a width of the stereo signal, the width control parameter being used by the first weighting function for weighting the first power spectrum and by the second weighting function for weighting the second power spectrum; and/or a user interface for providing the width control parameter.

The memory of a conventional apparatus can be used for storing the width control parameter. An existing user interface can be used to provide the width control parameter. Alternatively a slider can be used for realizing the user interface which is easy to implement. Thus, the user is able to control the stereo width thereby improving his quality of experience.

In a second possible implementation form of the apparatus according to the third aspect as such or according to the first implementation form of the third aspect, the width control parameter is an exponent applied to the first and the second power spectra, the exponent lying in a range between 0.5 and 2.

The range between 0.5 and 2 is an optimal range for controlling the stereo width.

The apparatus provides a way to change stereo width when generating stereo signals from a pair of microphones or postprocessing stereo signals, in particular from a pair of omni-directional microphones. The microphones can be integrated in the apparatus, e.g. in a mobile device, or they can be external and integrated over the headphones, for example, providing the left and right microphone signals to the mobile device. The smaller the distance between the two microphones for capturing the input stereo signal the larger the possible improvement of the perceived stereo width of the output stereo signal provided by implementation forms of the invention.

According to a fourth aspect, the invention relates to a method for capturing a stereo signal, the method comprising receiving a first and a second microphone signal; generating a first and a second differential signal; estimating the first and the second spectra; computing modified spectra by applying an exponent; computing a first and a second gain filter as weighting functions based on the modified spectra; and applying the gain filters to the first and second microphone signals to obtain the first and second output audio channel signals.

According to a fifth aspect, the invention relates to a method for computing a stereo signal, the method comprising computing a left and a right differential microphone signal from a left and a right microphone signal; computing powers of the differential microphone signals; applying an exponential to the powers; computing gain factors for the left and right microphone signals; and applying the gain factors to the left and right microphone signals.

The methods, systems and devices described herein may be implemented as software in a Digital Signal Processor (DSP), in a micro-controller or in any other side-processor or as hardware circuit within an application specific integrated circuit (ASIC).

The invention can be implemented in digital electronic circuitry, or in computer hardware, firmware, software, or in combinations thereof, e.g. in available hardware of conventional mobile devices or in new hardware dedicated for processing the methods described herein.

BRIEF DESCRIPTION OF DRAWINGS

Further embodiments of the invention will be described with respect to the following figures, in which.

DESCRIPTION OF EMBODIMENTS

In the following, implementation forms of the invention will be described, wherein the first input audio channel signal is a first microphone signal of a first microphone and the second input audio channel signal is a second microphone signal of a second microphone.

Figure 2:
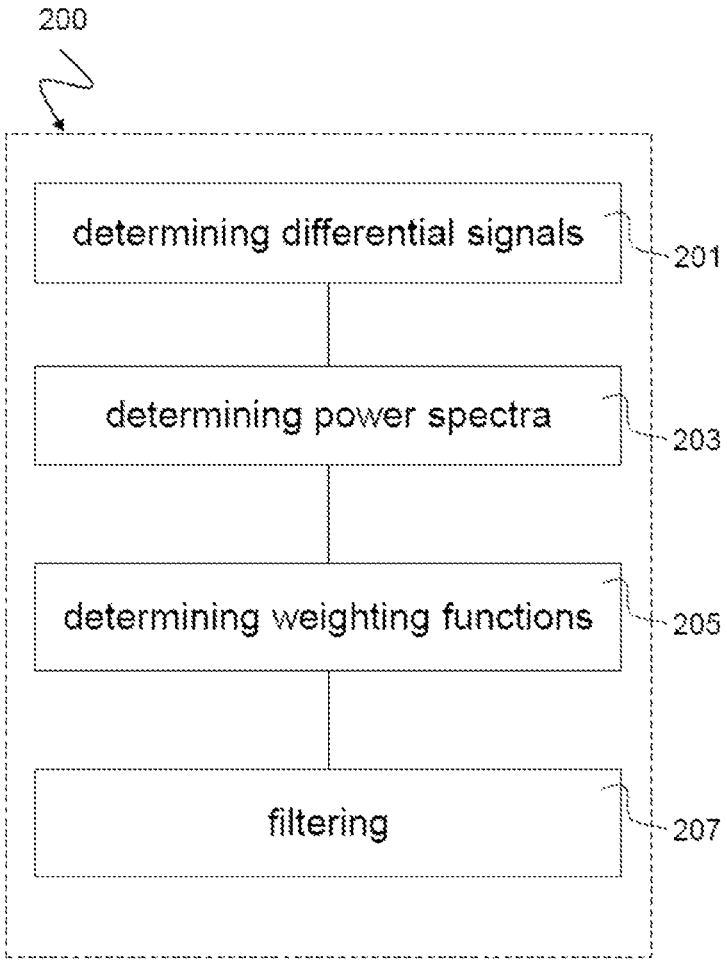
FIG. 2 shows a schematic diagram of a method for determining an output stereo signal according to an implementation form.

FIG. 2 shows a schematic diagram of a method 200 for determining an output stereo signal according to an implementation form.

The output stereo signal is determined from a first microphone signal of a first microphone and a second microphone signal of a second microphone. The method 200 comprises determining 201 a first differential signal based on a difference of the first microphone signal and a filtered version of the second microphone signal and determining a second differential signal based on a difference of the second microphone signal and a filtered version of the first microphone signal. The method 200 comprises determining 203 a first power spectrum based on the first differential signal and determining a second power spectrum based on the second differential signal. The method 200 comprises determining 205 a first and a second weighting function as a function of the first and the second power spectra; wherein the first and the second weighting function comprise an exponential function. The method 200 comprises filtering 207 a first signal representing a first combination of the first and the second microphone signal with the first weighting function to obtain a first output audio channel signal of the output stereo signal and filtering a second signal representing a second combination of the first and the second microphone signal with the second weighting function to obtain a second output audio channel signal of the output stereo signal.

In an implementation form of the method 200, the first signal is the first microphone signal and the second signal is the second microphone signal. In another implementation form of the method 200, the first signal is the first differential signal and the second signal is the second differential signal. In an implementation form of the method 200, an exponent or a value of an exponent of the exponential function lies between 0.5 and 2. In an implementation form of the method 200, the determining the first and the second weighting function comprises normalizing an exponential version of the first power spectrum by a normalizing function; and normalizing an exponential version of the second power spectrum by the normalizing function, wherein the normalizing function is based on a sum of the exponential version of the first power spectrum and the exponential version of the second power spectrum. In an implementation form of the method 200, the first and the second weighting functions depend on a power spectrum of a diffuse sound of the first and second microphone signals, in particular a reverberation sound of the first and second microphone signals. In an implementation form of the method 200, the first and the second weighting functions depend on a normalized cross correlation between the first and the second differential signals. In an implementation form of the method 200, the first and the second weighting functions depend on a minimum of the first and the second power spectra. In an implementation form of the method 200, the determining the first ($W_1$) and the second ($W_2$) weighting function comprises:

$$W_1(k, i) = \sqrt{\frac{P_1^{\beta}(k, i)}{P_1^{\beta}(k, i) + P_2^{\beta}(k, i)}}$$

-continued and $$W_2(k,i)=\sqrt{\frac{P_2^{\beta}(k,i)}{P_1^{\beta}(k,i)+P_2^{\beta}(k,i)}},$$

or comprises:

$$W_1(k,i)=\sqrt{\frac{P_1^{\beta}(k,i)+(g-1)D^{\beta}(k,i)}{P_1^{\beta}(k,i)+P_2^{\beta}(k,i)}}$$

and $$W_2(k,i)=\sqrt{\frac{P_2^{\beta}(k,i)+(g-1)D^{\beta}(k,i)}{P_1^{\beta}(k,i)+P_2^{\beta}(k,i)}},$$

where $P_1(k,i)$ denotes the first power spectrum, $P_2(k,i)$ denotes the second power spectrum, $W_1(k,i)$ denotes the weighting function with respect to the first power spectrum, $W_2(k,i)$ denotes the weighting function with respect to the second power spectrum, $D(k,i)$ is a power spectrum of a diffuse sound determined as $D(k,i)=\Phi(k,i)\min(P_1(k,i), P_2(k,i))$, where $\Phi(k,i)$ is a normalized cross-correlation between the first and the second differential signals, g is a gain factor, $\beta$ is an exponent, k is a time index and i is a frequency index. Such weighting functions are described in more detail below with respect to FIG. 3.

In an implementation form of the method 200, the method further comprises determining a spatial cue, in particular one of a channel level difference, an inter-channel time difference, an inter-channel phase difference and an inter-channel coherence/cross correlation based on the first and the second channel of the stereo signal. In an implementation form of the method 200, the first and the second microphones are omni-directional microphones. In an implementation form of the method 200, the filtered version of the first microphone signal is a delayed version of the first microphone signal and the filtered version of the second microphone signal is a delayed version of the second microphone signal.

Figure 3:
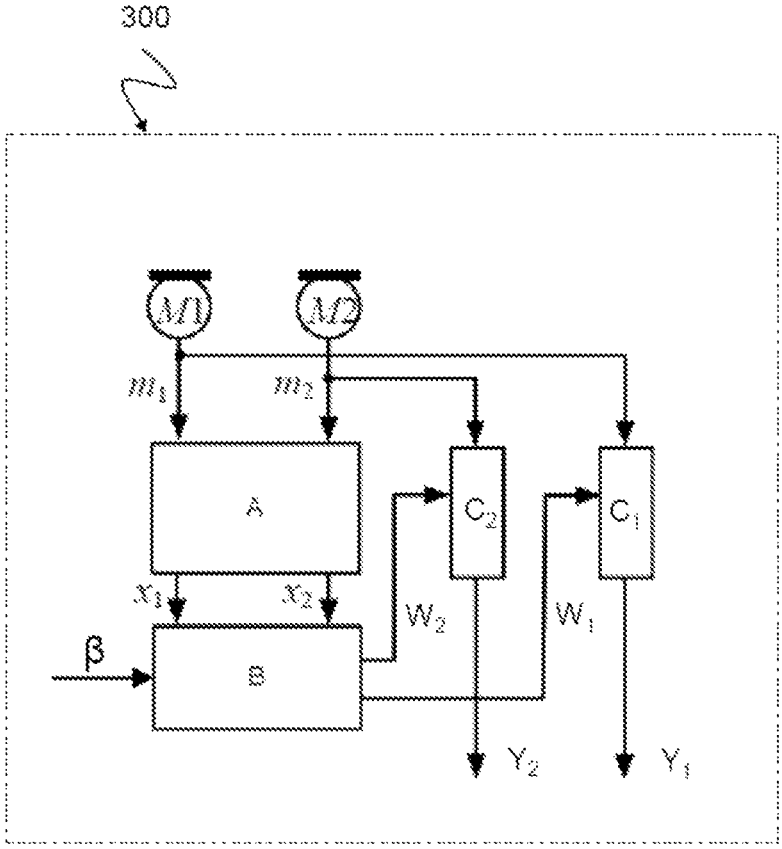
FIG. 3 shows a schematic diagram of a method for determining an output stereo signal using width control according to an implementation form.

FIG. 3 shows a schematic diagram of a method 300 for determining an output stereo signal using width control according to an implementation form.

The output stereo signal $Y_1$, $Y_2$ is determined from a first microphone signal $m_1$ of a first microphone $M_1$ and a second microphone signal $m_2$ of a second microphone $M_2$. The method 300 comprises determining a first differential signal $x_1$ based on a difference of the first microphone signal $m_1$ and a filtered version of the second microphone signal $m_2$ and determining a second differential signal $x_2$ based on a difference of the second microphone signal $m_2$ and a filtered version of the first microphone signal $m_1$. The determining the differential signals $x_1$ and $x_2$ is denoted by the processing block A. The method 300 comprises determining a first power spectrum $P_1$ based on the first differential signal $x_1$ and determining a second power spectrum $P_2$ based on the second differential signal $x_2$. The method 300 comprises weighting the first $P_1$ and the second $P_2$ power spectra by a weighting function obtaining weighted first $W_1$ and second $W_2$ power spectra. The determining the power spectra $P_1$ and $P_2$ and the weighting the power spectra $P_1$ and $P_2$ to obtain the weighted power spectra $W_1$ and $W_2$ is denoted by the processing block B. The weighting is based on a weighting control parameter $\beta$, e.g., an exponent. The method 300 comprises adjusting a first gain filter $C_1$ based on the weighted first power spectrum $W_1$ and adjusting a second gain filter $C_2$ based on the weighted second power spectrum $W_2$. The method 300 comprises filtering the first microphone signal $m_1$ with the first gain filter $C_1$ and filtering the second microphone signal $m_2$ with the second gain filter $C_2$ to obtain the output stereo signal $Y_1$, $Y_2$. The method 300 corresponds to the method 200 described above with respect to FIG. 2.

Figure 1:
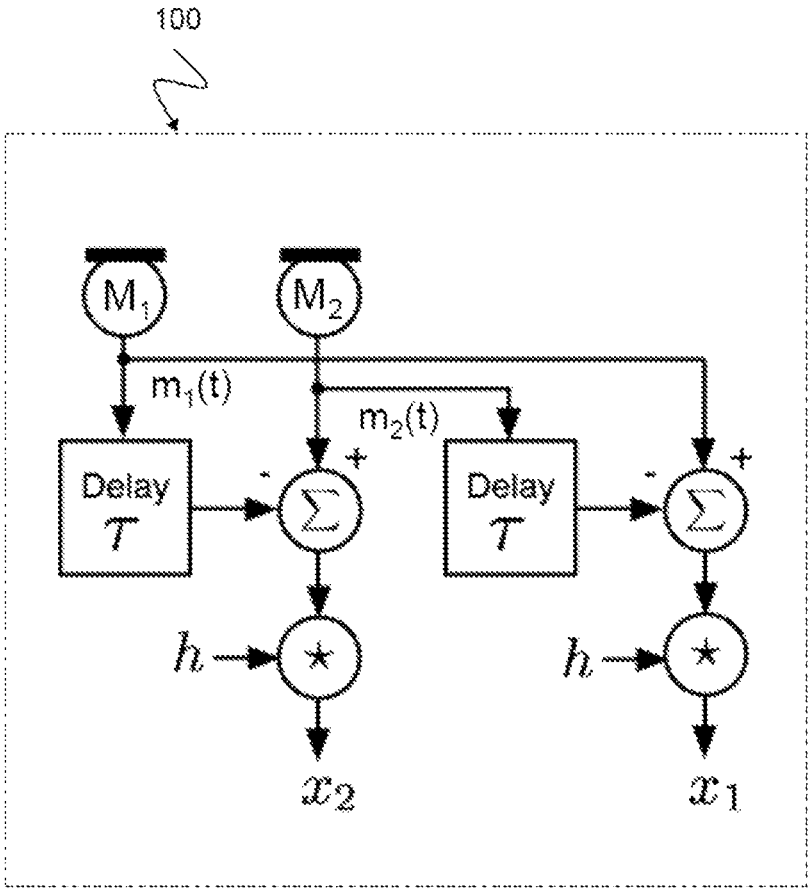
FIG. 1 shows a schematic diagram of a conventional method for generating a stereo signal.

The pressure gradient signals $m_1(t-\tau)-m_2(t)$ and $m_2(t-\tau)-m_1(t)$ described above with respect to FIG. 1 could potentially be useful stereo signals. However, at low frequencies, noise is amplified because the free-field response correction filter h(t) depicted in FIG. 1 amplifies noise at low frequencies. To avoid amplified low frequency noise in the output stereo signal, the pressure gradient signals $x_1(t)$ and $x_2(t)$ are not used directly as signals, but only their statistics are used to estimate (time-variant) filters which are applied to the original microphone signals $m_1(t)$ and $m_2(t)$ for generating the output stereo signal $Y_1(t)$, $Y_2(t)$.

In the following, time-discrete signals are considered, whereas time t is replaced with the discrete time index n. A time-discrete short-time Fourier transform (STFT) representation of a signal, e.g. $x_1(t)$, is denoted $X_1(k,i)$, where k is the time index and i is the frequency index. In FIG. 3, only the corresponding time signals are indicated. In an implementation form of the method 300 a first step of the method 300 comprises applying a STFT to the input signals $m_1(t)$ and $m_2(t)$ coming from the two omni-directional microphones M1 and M2. In an implementation form of the method 300, block A corresponds to the computing of the first order differential signals $x_1$ and $x_2$ described above with respect to FIG. 1.

The STFT spectra of the left and right stereo output signals are computed as follows:

$$Y_1(k,i)=W_1(k,i)M_1(k,i)$$

$$Y_2(k,i)=W_2(k,i)M_2(k,i), \tag{1}$$

where $M_1(k, i)$ and $M_2(k, i)$ are the STFT representation of the original omni-directional microphone signals $m_1(t)$ and $m_2(t)$ and $W_1(k,i)$ and $W_2(k,i)$ are filters which are described in the following.

The power spectrum of the left and right differential signals $x_1$ and $x_2$ is estimated as $$P_1(k,i)=E\{X_1(k,i)X^*_1(k,i)\}$$

$$P_2(k,i)=E\{X_2(k,i)X^*_2(k,i)\}, \tag{2}$$

where * denotes complex conjugate and $E\{.\}$ is a short-time averaging operation.

Based on $P_1(k,i)$ and $P_2(k,i)$, the stereo gain filters are computed as follows:

$$W_1(k,i)=\sqrt{\frac{P_1^{\beta}(k,i)}{P_1^{\beta}(k,i)+P_2^{\beta}(k,i)}} \tag{3}$$

$$W_2(k,i)=\sqrt{\frac{P_2^{\beta}(k,i)}{P_1^{\beta}(k,i)+P_2^{\beta}(k,i)}},$$

where the exponent $\beta$ controls the stereo width. For $\beta=1$ the stereo width of the differential signals is used, for $\beta>1$ the image is made wider and for $\beta<1$ the image is made narrower. In an implementation form, $\beta$ is selected in the range between 0.5 and 2.

In an implementation form, a power spectrum of an undesired signal, such as noise or reverberation is estimated. In an implementation form, diffuse sound (reverberation) is estimated as follows:

$$D(k,i)=\Phi(k,i)\min(P_1(k,i), P_2(k,i)), \quad (4)$$

where $\Phi(k,i)$ denotes the normalized cross-correlation between the left and right differential signals $x_1$ and $x_2$. Based on these estimates, the left and right gain filters $W_1(k,i)$ and $W_2(k,i)$ are computed as follows:

$$W_1(k, i) = \sqrt{\frac{P_1^{\beta}(k, i) + (g-1)D^{\beta}(k, i)}{P_1^{\beta}(k, i) + P_2^{\beta}(k, i)}} \quad (5)$$

$$W_2(k, i) = \sqrt{\frac{P_2^{\beta}(k, i) + (g-1)D^{\beta}(k, i)}{P_1^{\beta}(k, i) + P_2^{\beta}(k, i)}},$$

where $$g = 10^{\frac{L}{10}}$$

denotes the gain given to the undesired signal to attenuate it and L denotes the attenuation in decibels (dB).

Figure 4:
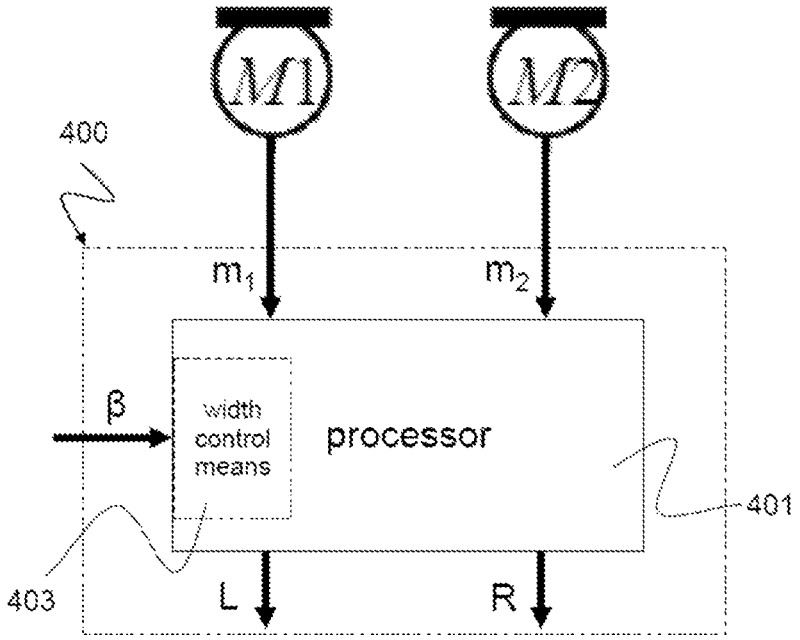
FIG. 4 shows a schematic diagram of an apparatus, e.g. mobile device, according to an implementation form.

FIG. 4 shows a schematic diagram of an apparatus, e.g. a mobile device, 400 according to an implementation form.

The mobile device 400 comprises a processor 401 for determining an output stereo signal L, R from a first microphone signal $m_1$ provided by a first microphone $M_1$ and a second microphone signal $m_2$ provided by a second microphone $M_2$. The processor 401 is adapted to apply any of the implementation forms of method 200 described with respect to FIG. 2 or of method 300 described with respect to FIG. 3. In an implementation form, the mobile device 400 comprises width control means 403 for receiving a width control parameter β controlling a width of the output stereo signal L, R. The width control parameter β is used by the weighting function for weighting the first $P_1$ and the second $P_2$ power spectra as described above with respect to FIG. 3.

In an implementation form of the mobile device 400, the width control means 403 comprises a memory for storing the width control parameter β. In an implementation form of the mobile device 400, the width control means 403 comprises a user interface for providing the width control parameter β. In an implementation form of the mobile device 400, the width control parameter β is an exponent applied to the first $P_1$ and the second $P_2$ power spectra, the exponent β is lying in a range between 0.5 and 2.

In an implementation form, the microphones M1, M2 are omni-directional microphones. The two omni-directional microphones M1, M2 are connected to the system which applies the stereo conversion method. In an implementation form, the microphones are microphones mounted on earphones which are connected to the mobile device 400. In an implementation form, the mobile device is a smartphone or a tablet.

In an implementation form, the method 200, 300 as described above with respect to FIGS. 2 and 3 is applied in the mobile device 400 in order to improve and control the stereo width of the stereo recording. In an implementation form, the width control parameter β is stored in memory as a predetermined or fixed parameter provided by the manufacturer of the mobile device 400. In an alternative implementation form, the width control parameter β is obtained from a user interface which gives the possibility to the user to adjust the stereo width. In an implementation form, the user controls the stereo width with a slider. In an implementation form, the slider controls the parameter β between 0.5 and 2.

In an implementation form, the mobile device 400 is, for example, one of the following devices: a cellular phone, a smartphone, a tablet, a notebook, a portable gaming device, an audio recording device such as a Dictaphone or an audio recorder, a video recording device such as a camera or a camcorder.

Figure 5:
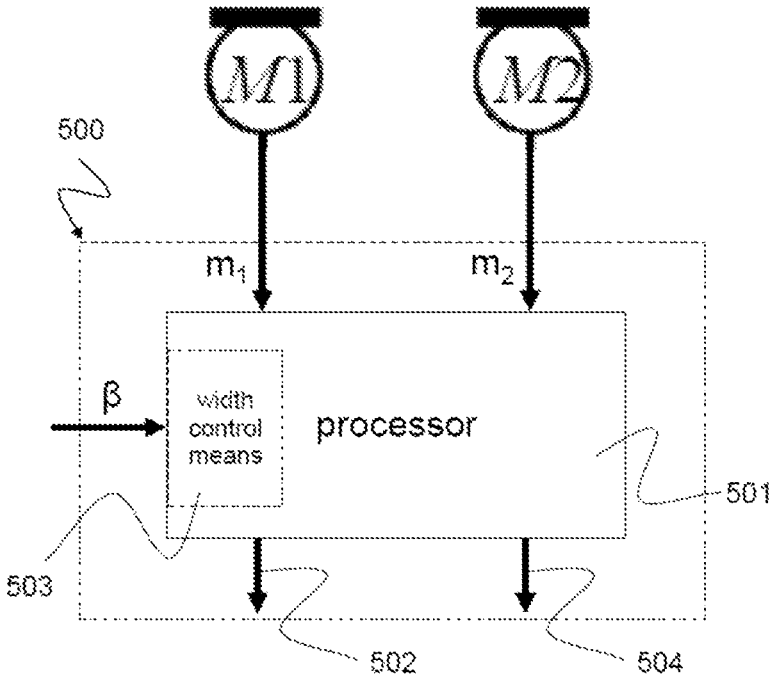
FIG. 5 shows a schematic diagram of an apparatus, e.g. a mobile device, computing a parametric stereo signal according to an implementation form.

FIG. 5 shows a schematic diagram of an apparatus, e.g. a mobile device, 500 for computing a parametric stereo signal 504 according to an implementation form.

The mobile device 500 comprises a processor 501 for generating a parametric stereo signal 504 from a first microphone signal $m_1$ provided by a first microphone $M_1$ and a second microphone signal $m_2$ provided by a second microphone $M_2$. The processor 501 is adapted to apply any of the implementation forms of the method 200 described with respect to FIG. 2 or of the method 300 described with respect to FIG. 3. In an implementation form, the mobile device 500 comprises width control means 503 for receiving a width control parameter β controlling a width of the parametric stereo signal 504. The width control parameter β is used by the weighting function for weighting the first $P_1$ and the second $P_2$ power spectra as described above with respect to FIG. 3 or FIG. 2. The processor 501 may comprise the same functionality as the processor 401 described above with respect to FIG. 4. The width control means 503 may correspond to the width control means 403 described above with respect to FIG. 4.

The two microphones $M_1$, $M_2$, e.g., omni-directional microphones, are connected to the mobile device 500 based on a low bit rate stereo coding. This coding/decoding paradigm can use a parametric representation of the stereo signal known as "Binaural Cue Coding" (BCC), which is presented in details in "Parametric Coding of Spatial Audio," C. Faller, Ph.D. Thesis No. 3062, Ecole Polytechnique Fédérale de Lausanne (EPFL), 2004. In this document, a parametric spatial audio coding scheme is described. This scheme is based on the extraction and the coding of inter-channel cues that are relevant for the perception of the auditory spatial image and the coding of a mono or stereo representation of the multichannel audio signal. The inter-channel cues are Interchannel Level Differences (ILD) also known as Channel Level Differences (CLD), Interchannel Time Differences (ITD) which can also be represented with Interchannel Phase Differences (IPD), and Interchannel Coherence/Cross Correlation (ICC). The inter-channel cues can be extracted based on a sub-band representation of the input signal, e.g., by using a conventional STFT or a Complex-modulated Quadrature Mirror Filter (QMF). The sub-bands are grouped in parameter bands following a non-uniform frequency resolution which mimics the frequency resolution of the human auditory system. The mono or stereo downmix signal 502 is obtained by matrixing the original multichannel audio signal. This downmix signal 502 is then encoded using conventional state-of-the-art mono or stereo audio coders. In an implementation form, the mobile device 500 outputs the downmix signal 502 or the encoded downmix signal using conventional state-of-the-art audio coders.

In an implementation form, the mono downmix signal 502 is computed according to "Parametric Coding of Spatial Audio," C. Faller, Ph.D. Thesis No. 3062, EPFL, 2004.

Alternatively, other downmixing methods are used. In an implementation form, the Channel Level Differences which are computed per sub-band as:

$$CLD[b] = 10\log_{10}\frac{\sum_{k=k_b}^{k_{b+1}-1} M_1[k]M_1^*[k]}{\sum_{k=k_b}^{k_{b+1}-1} M_2[k]M_2^*[k]} \quad (6)$$

are adapted according to the following:

$$CLD[b] = 10\log_{10}\frac{\sum_{k=k_b}^{k_{b+1}-1} Y_1[k]Y_1^*[k]}{\sum_{k=k_b}^{k_{b+1}-1} Y_2[k]Y_2^*[k]} \quad (7)$$

to take into account the stereo width control. $Y_1[k]$, $Y_2[k]$ corresponds to the two output audio channel signals of the output stereo signal determined by the implementation forms as described above with respect to FIGS. 2 to 4. In an implementation form comprising additionally parametric audio encoding, the (modified) stereo signal $Y_1[k]$, $Y_2[k]$ is used as intermediate signal $Y_1[k]$, $Y_2[k]$ to compute the spatial cues (CLD, ICC and ITD) which are then output as the stereo parametric signal or side information 504 together with the downmix signal 502.

The width control parameter β can be stored in memory, as a predetermined parameter provided by the manufacturer of the mobile device 500. Alternatively, the width control parameter β is obtained from a user interface which gives the possibility to the user to adjust the stereo width. The user can control the stereo width by using for instance a slider which controls the parameter β between 0.5 and 2.

Although implementations of the invention (method, computer program and apparatus) have been primarily described based implementations wherein the first input audio channel signal is a first microphone signal of a first microphone and the second input audio channel signal is a second microphone signal of a second microphone, implementations of the invention are not limited to such. Implementation forms of the invention can be applied to any input stereo signal, previously encoded and decoded, for example for transmission or storage of the stereo signal, or not. In case of encoded input stereo signals, implementations of the invention may comprise decoding the encoded stereo signal, i.e. reconstructing a first and second input audio channel signal from the encoded stereo signal before determining the differential signals, etc. In further implementation forms the first input and output audio channel signals can be left input and output audio channel signals and the second input and output audio channel signals can be right input and output audio channel signals, or vice versa. The value of the exponent of the exponential function can be fixed or adjustable, in both cases the value lying in a range of values including or excluding the value 1, wherein a value smaller than 1 allows to narrow the stereo width of the output stereo signal and a value larger than 1 allows to broaden the stereo width of the output stereo signal. The value of the exponent may lie within a range from 0.5 to 2. In alternative implementation forms the value of the exponent may lie within a range from 0.25 to 4, from 0.2 to 5 or from 0.1 and 10 etc.

Although the implementations of the apparatus have been described primarily for mobile devices, for example based on FIGS. 4 and 5, implementation forms of the apparatus can be any device adapted to perform any of the implementation forms of the method according to the first aspect as such or any of the implementation forms according to the first aspect. The apparatus can be, for example, a mobile device adapted to capture the input stereo signal by external or built-in microphones and to determine the output stereo signal by performing the method according to the first aspect as such or any of the implementations forms according to the first aspect. The apparatus can also be, for example, a network device or any other device connected to a device capturing or providing a stereo signal in encoded or non-encoded manner, and adapted to postprocess the stereo signal received from this capturing device as input stereo signal to determine the output stereo signal by performing the method according any of the implementation forms described above.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

Many alternatives, modifications, and variations will be apparent to those skilled in the art in light of the above teachings. Of course, those skilled in the art readily recognize that there are numerous applications of the invention beyond those described herein. While the present inventions has been described with reference to one or more particular embodiments, those skilled in the art recognize that many changes may be made thereto without departing from the scope of the present invention. It is therefore to be understood that within the scope of the appended claims and their equivalents, the inventions may be practiced otherwise than as described herein.

The invention claimed is:

1. A method for determining an output stereo signal based on an input stereo signal, the input stereo signal comprising a first input audio channel signal and a second input audio channel signal, the method comprising:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein an exponent of the exponential function lies between 0.5 and 2.

2. The method of claim 1, wherein the first signal is the first input audio channel signal and the second signal is the second input audio channel signal.

3. The method of claim 1, wherein the first signal is the first differential signal and the second signal is the second differential signal.

4. The method of claim 1, further comprising determining a spatial cue, in particular one of a channel level difference, an inter-channel time difference, an inter-channel phase difference and an inter-channel coherence/cross correlation based on the first output audio channel signal and the second output audio channel signal of the output stereo signal.

5. The method of claim 1, wherein the filtered version of the first input audio channel signal is a delayed version of the first input audio channel signal, and wherein the filtered version of the second input audio channel signal is a delayed version of the second input audio channel signal.

6. The method of claim 1, wherein the first input audio channel signal is a first microphone signal of a first microphone, and the second input audio channel signal is a second microphone signal of a second microphone.

7. The method of claim 1, wherein the first and the second microphones are omni-directional microphones.

8. A method for determining an output stereo signal based on an input stereo signal, the input stereo signal comprising a first input audio channel signal and a second input audio channel signal, the method comprising:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein determining the first and the second weighting function comprises:

normalizing an exponential version of the first power spectrum by a normalizing function; and normalizing an exponential version of the second power spectrum by the normalizing function, wherein the normalizing function is based on a sum of the exponential version of the first power spectrum and the exponential version of the second power spectrum.

9. A method for determining an output stereo signal based on an input stereo signal, the input stereo signal comprising a first input audio channel signal and a second input audio channel signal, the method comprising:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein the first and the second weighting functions depend on a power spectrum of a diffuse sound of the first input audio channel signal and the second input audio channel signal, in particular a reverberation sound of the first input audio channel signal and the second input audio channel.

10. A method for determining an output stereo signal based on an input stereo signal, the input stereo signal comprising a first input audio channel signal and a second input audio channel signal, the method comprising:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein the first and the second weighting functions depend on a normalized cross correlation between the first and the second differential signals.

11. A method for determining an output stereo signal based on an input stereo signal, the input stereo signal comprising a first input audio channel signal and a second input audio channel signal, the method comprising:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein the first and the second weighting functions depend on a minimum of the first and the second power spectra.

12. A method for determining an output stereo signal based on an input stereo signal, the input stereo signal comprising a first input audio channel signal and a second input audio channel signal, the method comprising:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein determining the first and the second weighting function comprises:

$$W_1(k, i) = \sqrt{\frac{P_1^\beta(k, i)}{P_1^\beta(k, i) + P_2^\beta(k, i)}}$$

and

-continued $$W_2(k, i) = \sqrt{\frac{P_2^\beta(k, i)}{P_1^\beta(k, i) + P_2^\beta(k, i)}},$$

or comprises:

$$W_1(k, i) = \sqrt{\frac{P_1^\beta(k, i) + (g-1)D^\beta(k, i)}{P_1^\beta(k, i) + P_2^\beta(k, i)}}$$

and $$W_2(k, i) = \sqrt{\frac{P_2^\beta(k, i) + (g-1)D^\beta(k, i)}{P_1^\beta(k, i) + P_2^\beta(k, i)}},$$

where $P_1(k,i)$ denotes the first power spectrum, $P_2(k,i)$ denotes the second power spectrum, $W_1(k,i)$ denotes the weighting function with respect to the first power spectrum, $W_2(k,i)$ denotes the weighting function with respect to the second power spectrum, $D(k,i)$ is a power spectrum of a diffuse sound determined as $D(k,i)=\Phi(k,i)\min(P_1(k,i),P_2(k,i))$, where $\Phi(k,i)$ is a normalized cross-correlation between the first and the second differential signals, g is a gain factor, $\beta$ is an exponent of the exponential function, k is a time index and i is a frequency index.

13. An apparatus for determining an output stereo signal based on an input stereo signal, the input stereo signal comprising a first input audio channel signal and a second input audio channel signal, the apparatus comprising a processor for generating the output stereo signal from the first input audio channel signal and the second input audio channel signal by applying a method, wherein the method is for determining an output stereo signal based on an input stereo signal, wherein the input stereo signal comprises a first input audio channel signal and a second input audio channel signal, and wherein the method comprises:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein the apparatus comprises:

a memory for storing a width control parameter controlling a width of the stereo signal, the width control parameter being used by the first weighting function for weighting the first power spectrum and by the second weighting function for weighting the second power spectrum; and/or a user interface for providing the width control parameter.

14. An apparatus for determining an output stereo signal based on an input stereo signal, the input stereo signal comprising a first input audio channel signal and a second input audio channel signal, the apparatus comprising a processor for generating the output stereo signal from the first input audio channel signal and the second input audio channel signal by applying a method, wherein the method is for determining an output stereo signal based on an input stereo signal, wherein the input stereo signal comprises a first input audio channel signal and a second input audio channel signal, and wherein the method comprises:

determining a first differential signal based on a difference of the first input audio channel signal and a filtered version of the second input audio channel signal, and determining a second differential signal based on a difference of the second input audio channel signal and a filtered version of the first input audio channel signal;

determining a first power spectrum based on the first differential signal and determining a second power spectrum based on the second differential signal;

determining a first weighting function and a second weighting function as a function of the first power spectrum and the second power spectrum, wherein the first weighting function and the second weighting function comprise an exponential function; and filtering a first signal, which represents a first combination of the first input audio channel signal and the second input audio channel signal, with the first weighting function to obtain a first output audio channel signal of the output stereo signal, and filtering a second signal, which represents a second combination of the first input audio channel signal and the second input audio channel signal, with the second weighting function to obtain a second output audio channel signal of the output stereo signal, wherein the width control parameter is an exponent applied to the first and the second power spectra, the exponent lying in a range between 0.5 and 2.

15. The apparatus of claim 14, wherein the apparatus is a mobile device comprising a first microphone and a second microphone, and wherein the first input audio channel signal is a first microphone signal of the first microphone, and the second input audio channel signal is a second microphone signal of the second microphone.

* * * * *